US005707062A

United States Patent [19]

Perillo et al.

[11] Patent Number: 5,707,062

[45] Date of Patent: Jan. 13, 1998

[54] DUAL PLAY BUCKET BALL GAME AND DEVICE

[76] Inventors: Michael T. Perillo; Cynthia E. Perillo, both of 264 Dutch Farm Rd., Bridgewater, N.J. 08807

[21] Appl. No.: 550,363

[22] Filed: Oct. 30, 1995

[51] Int. Cl.[6] ..... A63B 63/08

[52] U.S. Cl. ..... 273/354; 273/400

[58] Field of Search ..... 273/398–400, 273/351–357, 348

[56] References Cited

U.S. PATENT DOCUMENTS

| | | | |
|---|---|---|---|
| 324,189 | 8/1885 | Thomas | 273/400 |
| 1,442,054 | 1/1923 | Dixon | 273/400 |
| 2,247,852 | 7/1941 | Saunders | 273/400 |
| 3,495,830 | 2/1970 | Farrelli | 273/400 |
| 4,335,881 | 6/1982 | Warehime . | |
| 4,392,653 | 7/1983 | Blume, Sr. . | |
| 4,877,256 | 10/1989 | Falloon . | |
| 4,989,880 | 2/1991 | Gettemeier et al. | 273/400 |
| 5,123,656 | 6/1992 | Green . | |
| 5,290,040 | 3/1994 | Boroski . | |
| 5,333,865 | 8/1994 | Holmes . | |

*Primary Examiner*—Mark S. Graham
*Attorney, Agent, or Firm*—Kenneth P. Glynn, Esq.

[57] ABSTRACT

The bucket ball game utilizes a base with a hole enclosed by a receptacle configured as a cone. The preferred method of playing the game is to award players one point for tossing a ball that makes contact with any part of the bucket, award two points to a player for tossing a ball that enters the inside of the bucket and comes out of the bucket, and award three points to a player for tossing a ball that enters the bucket and remains inside the bucket. To equalize the chance of winning by any team, more skilled players can be made to throw at the bucket from a farther distance then the less skilled players. In an alternative embodiment, the receptacle may be an assembly of bucket sections that can be singularly removed for players with lesser playing skills.

14 Claims, 2 Drawing Sheets

DUAL PLAY BUCKET BALL GAME AND DEVICE

BACKGROUND OF THE INVENTION

1. Field of the Invention

The present invention is directed toward a bucket ball game with a plastic molded receptacle having a conical configuration and a method of play allowing for team play and scoring to suit various player skills.

2. Information Disclosure Statement

Game methods and apparatus utilizing receptacles and tossing objects make common subject matter for patent applications. While the prior art teaches tossing objects into receptacles, it does not teach a method utilizing a simple receptacle that can accommodate a variety of playing skills possessed by children and adults alike. The present invention method prescribes a point system for either hitting the bucket, tossing an object which enters and exits the bucket or tossing an object which remains inside the bucket. The equipment used may be a one piece collapsible type bucket suitable for nested stacking with other buckets or a multi piece assembly type which may be disassembled for packaging or storage with minimal space occupancy.

Various configurations of tossing games have been patented. U.S. Pat. No. 4,355,881 issued to Warehim, entitled "Multi-Sectional Assembled Basket Goals And Their Games Usage", discloses three to six thin, pliable, plastic trapezoidal shaped sections that can be used to assemble a practical, convenient, lightweight bottomless type basket which can be used as a goal in a variety of simple indoor/outdoor team action games. The plastic sections have male-female interlocking side edge slip jointing means on two side edges and stiffening rims on the other two side edges.

U.S. Pat. No. 4,392,653 issued to Blume, Sr. discloses a game apparatus for playing a toss type skill game wherein the apparatus forms a target area for the game and has an open topped container defined by a bottom wall and a peripheral wall extending upwardly from around the bottom wall, a hole through the bottom wall at a location spaced from the peripheral wall, and a tubular member positioned extending upwardly from the bottom wall through the hole. The tubular member having an open upper side forming a target for receiving objects thrown at the apparatus. A second embodiment of the game apparatus is provided wherein the height of the tubular member may be varied for varying the difficulty of the game.

U.S. Pat. No. 4,877,256 issued to Falloon discloses a tossing game which utilizes a pair of target areas or trays placed on the ground at a desired distance from one another. Each of the target areas or trays has a plurality of cups of varying heights. The players toss projectiles (preferably disks) from a position adjacent one of the target areas to the other. Points are scored by landing a projectile either on the tray or in one of the cups, with the number of points increasing when the projectile lands in the taller ones of the cups.

U.S. Pat. No. 5,123,656 issued to Green discloses an apparatus for playing a game of toss.

A target receptacle includes at least an inner and an outer vertical receptacles with side walls such that volumes are defined within the inner wall and between the inner wall and the outer wall respectively. In the preferred embodiment, the outer wall includes a forward portion with a depending section proximate the top such that a larger opening for the passage of the tossing object is provided. The inner and outer walls do not move in relation to one another during play. Scoring is determined by the number of tossing objects landing within the separate volumes, with a greater number of points awarded for a tossing object landing within the central volume.

U.S. Pat. No. 5,290,040 issued to Boroski discloses an apparatus for an object tossing game, the game includes an object for tossing and a target assembly which includes a number of cylindrical cans and a base unit for supporting the cans. The base unit includes a floor and semi-circular back board. Two cans are located relatively close to the back board and are assigned lower point values than one can that is located relatively far from the back board. A flexible roll up support surface is provided for supporting the target assembly. The support surface can include indicia which indicate a number of predetermined positions at which the target assembly can be placed, or at which a player can stand, on the support surface. The predetermined positions on the support surface are representative of different levels of difficulty for a player to successfully target a can in the target assembly. The support surface can be rolled up into a housing which includes a coiled spring which supplies the energy for rolling up the support surface. In an alternative embodiment, two target assemblies and two flexible, roll up support surfaces are provided. Two coiled springs are provided in a housing for rolling up the two respective roll-up surfaces after the respective target assemblies have been removed from the surfaces.

U.S. Pat. No. 5,333,865 issued to Holmes discloses an amusement apparatus simulating the game of football. The apparatus includes a simulated playing field, a deck of cards bearing instructions for offensive football plays of designated types, a toy football made of soft material such as foam rubber, and a receiving figure. The receiving figure is formed of a flat vertical member, a base to which the flat upright member is attached and a receiving receptacle attached to the forward side of the vertical member. The receiving receptacle is of a size sufficiently large to receive the football and has enclosed side bottom and forward sidewalls and an open top.

Notwithstanding the prior art in this field, it is believed that the present invention which teaches a method of playing a toss game with a bucket that is configured to accommodate a variety of play skills and may be a one piece collapsible type or a multi sectional assembly type is neither taught nor rendered obvious.

SUMMARY OF TEE INVENTION

It is an object of the present invention to teach a method of playing a tossing game that is easily played and simple to understand by children and adults alike despite the varying playing skills possessed by such different players.

It is a further object of the present invention to teach a tossing game utilizing a bucket type receptacle that can be easily produced, simple to vary the scoring difficulty to accommodate different levels of playing skills and, easily nested with other such bucket type receptacles to minimize retail packaging space and costs or storage space.

The present invention is a method of playing a tossing game wherein the equipment consists of a bucket made with a cone shaped receptacle attached to a nearly flat base. The base has a hole surrounded by the receptacle for accommodating nested stacking of multiple buckets by inserted a collapsed receptacle of one bucket through the hole in the base of another bucket. The receptor or wide end of the cone is upright for receiving an attempted thrown object such as a ball. Method of play entails determining the number of teams and inclusion of which players into those teams, determining each players distance from the receptacle for throwing an object such as a ball, determining a sequence and frequency for players to take turns throwing a ball into the receptacle, and awarding one point for a player throwing a ball making contact with the receptacle, two points for a ball entering and exiting the receptor end of the receptacle and three points for a ball entering the receptor end and remaining in the receptacle.

In an alternative embodiment, level of play can be varied by utilizing a receptacle with a receptor end whose perimeter is acutely angled from the plane of the base. Play difficulty can be varied to accommodate the players skill level by turning the low side of the receptor end toward a younger or less skilled player or turning the high side toward an adult or more skilled player.

In yet a further alternative embodiment, the receptacle can be an assembly of bucket sections that can be removed singularly to narrow the receptor end for an adult or more skilled player. The bucket sections can be disassembled and nested for nearly flat packaging.

BRIEF DESCRIPTION OF THE DRAWINGS

The present invention should be more fully understood when the specification herein is taken in conjunction with the drawings appended thereto, wherein.

DETAILED DESCRIPTION OF THE PRESENT INVENTION

The present invention is directed to a toss game suitable for a variety of player skills. The game teaches use of a bucket whose receptacle is simple in configuration and thus simple for children to comprehend the manner in which the receptacle is utilized. The difficulty level in utilizing the receptacle can be varied by altering the distance from the receptacle of the bucket to toss a ball, or in an alternative embodiment the bucket sections can be removed to narrow the receptor end for more skilled players such as adults. The present invention game can be played with a ball, sandbag, rocks, weighted clothing articles or any other type of object suitable for tossing.

Removably attached or removably attachable as used herein can mean but is not limited to, mating threaded male and female attachments, mating male and female slip joints, friction fitted bead and groove joints or butt joints secured by detachable fasteners. The invention may be practiced with any other form of removable attachment known in the prior art to perform as well as the above disclosed attachments.

The base, receptacle or bucket sections amy be formed from plastic, or other elastomeric compounds by molding methods or formed from wood, metal or cardboard.

The present invention is detailed in FIGS. 1 through 7 with like elements or components being like numbered.

Figure 1:
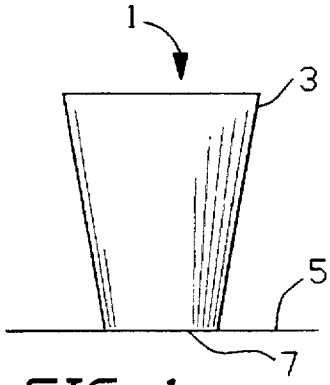
FIG. 1 is a side view of a bucket 1 utilized in the present invention bucket ball game.

Referring now to FIG. 1 there is shown a a side view of a bucket 1 utilized in the present invention. The base 5 is a nearly flat member and has a hole 7 of predetermined size which is enclosed by the receptacle 3. The receptacle 3 is preferably formed integrally with the base 5 and made from a soft pliable poly based material such as plastic or a rubber compound. Alternatively, the receptacle 3 may be removably attached to the base 5. The hole 7 permits nested stacking of multiple buckets by permitting a collapsed receptacle of one bucket to be inserted through the hole in the base of another bucket. The receptacle 3 as depicted here has a circular cross section at a right angle to the vertical center line of the receptacle and outwardly sloping inner and outer surface areas which is a cone configuration. In an alternative embodiment the receptacle may have a square cross section at a right angle to the vertical center line of the receptacle and outwardly sloping inner and outer surface areas.

Figure 2:
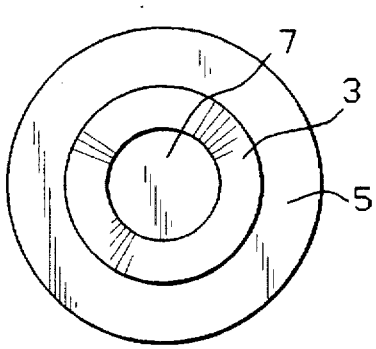
FIG. 2 is a top view of the bucket of FIG. 1.

FIG. 2 depicts a top view of the bucket 1 shown in FIG. 1. The receptacle is shown shaded since as a sloping surface it appears to have width from a top view.

Figure 3:
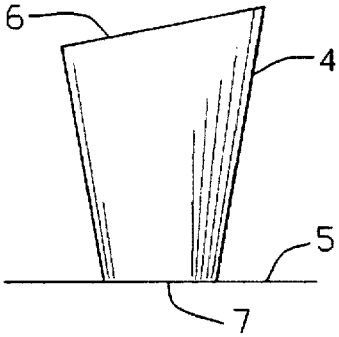
FIG. 3 is a side view of a bucket with a receptacle having a receptor end at an acute angle from the base.

Shown in FIG. 3 is a side view of a bucket with a receptacle 4 whose receptor end 6 is at an acute angle from the base 5. The difficulty level for a player tossing an object such as a ball into the receptacle 4 can be varied by orienting the low side toward the player to provide a greater receptor area for a player with less skill, such as a child, and turning the higher side toward a player to increase the difficulty level for a player with greater skill, such as an adult.

Figure 4:
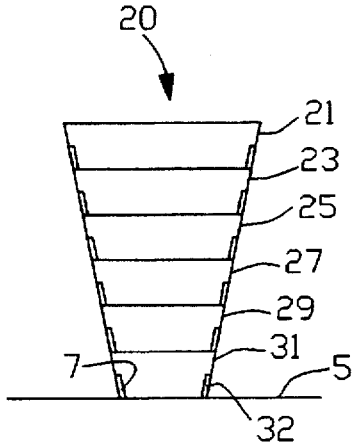
FIG. 4 is a side view of an alternative embodiment bucket with bucket sections that assemble to form the receptacle.

In a further alternative embodiment of practicing the present invention bucket ball game, there is shown in FIG. 4 a bucket 20 whose receptacle consists of bucket sections 21, 23, 25, 27, 29 and 31 that can be assembled and disassembled. The top section 21 has a receptor end which can receive a tossed object such as a ball and a mating end for removably attaching to another bucket section 23. The bucket sections 21, 23, 25, 27, 29 and 31 are removably attachable to one another in the sequence shown in FIG. 4. The bottom section 31 has a mounting end 32 which is removably attachable to the protruding shaped member 7 of the base 5 and a section end removably attachable to bucket section 29. Although FIG. 4 shows the bucket 20 as having 6 bucket sections, the invention may be practiced with a bucket having as few as 3 bucket sections such as a top section, intermediate section and bottom section for removably attaching to the protruding member 7 of the base 5. In an alternative embodiment the top section 21 may have an acutely angled receptor end as the receptor end 6 shown in FIG. 3.

Figure 5:
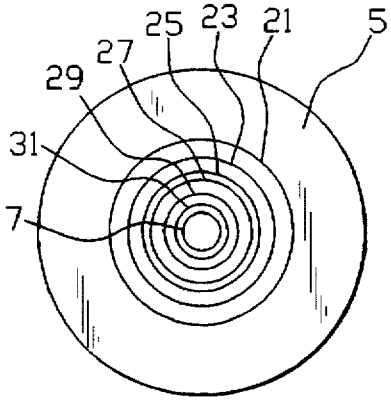
FIG. 5 is a top view of the alternative receptacle of FIG. 4.
Figure 6:
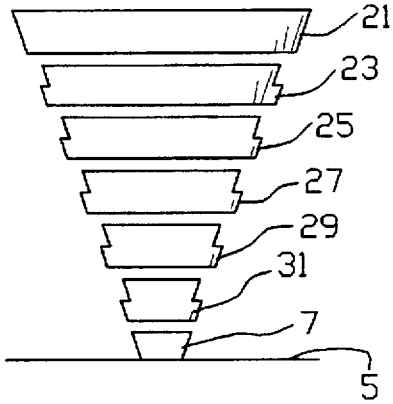
FIG. 6 is a side view of the alternative embodiment of the bucket of FIG. 4 with the bucket sections disassembled.

FIG. 5 shows a top view of the alternative receptacle of FIG. 4. FIG. 6 is a side view of the alternative embodiment receptacle of FIG. 4 with the bucket sections disassembled.

Figure 7:
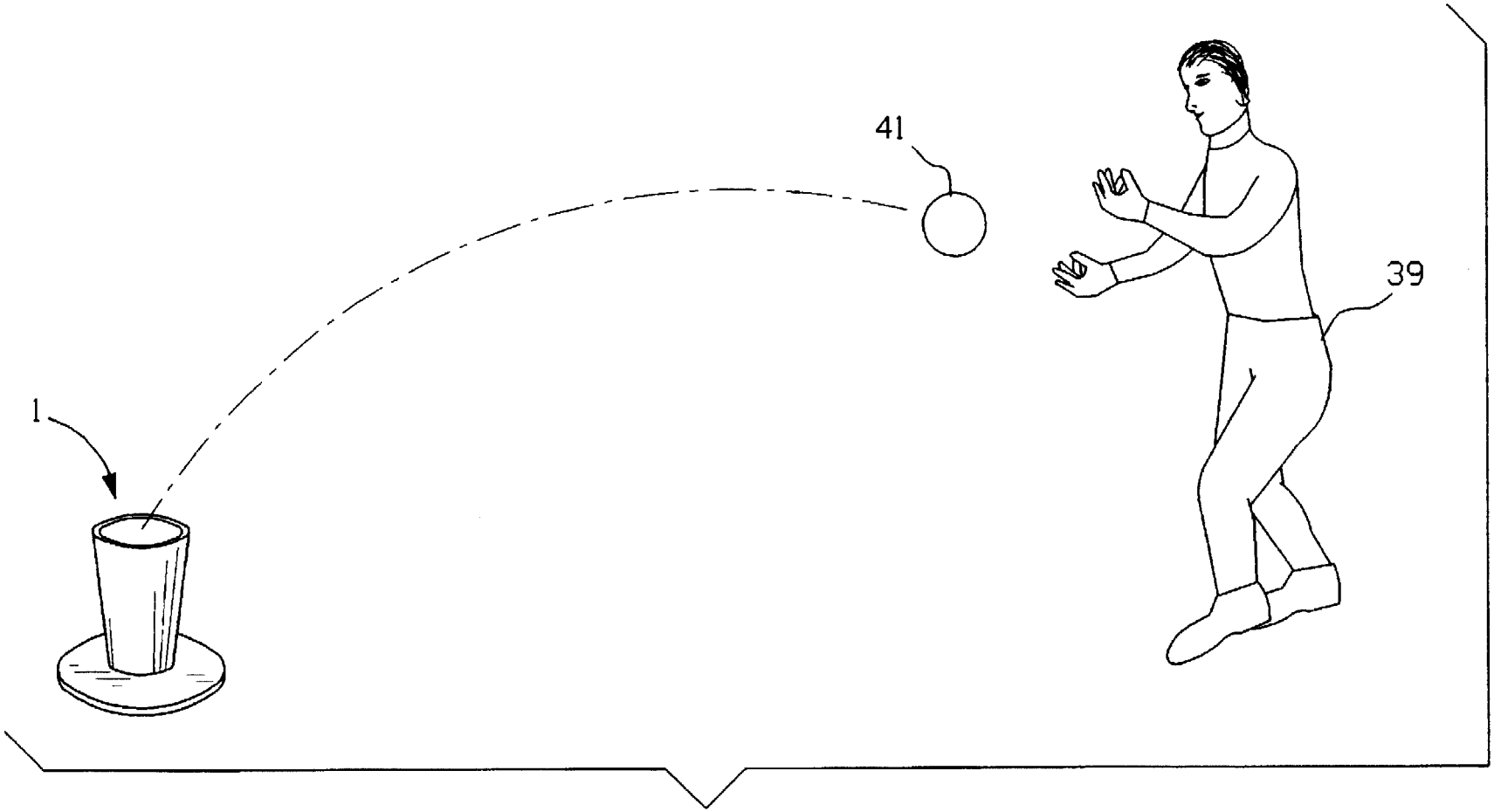
FIG. 7 is a perspective view of typical play with the dual bucket equipment of FIG. 1.

Shown in FIG. 7 is a perspective view of typical play with the bucket equipment of FIG. 1. The player 39 is shown attempting to toss a ball 41 into a distal bucket 1 which is a predetermined distance (shown as a line marked X) from the player 39. Upon player 39 completing a toss, a second player (not shown) may retrieve the ball 41 and attempt to toss the ball 41 into the bucket 1.

The preferred method of playing the dual bucket ball game with multiple players entails, not necessarily in the sequence disclosed nor with all the steps disclosed, determining the number of teams and inclusion of which players into the teams, optionally assigning to each player a predetermined distance for tossing a ball into the receptacle, determining a sequence for players to take turns tossing a ball into the receptacle of the bucket, determining the number of times each player tosses a ball into the receptacle of the bucket, and having each player or team alternate tossing the ball at their own separate target receptacles. The bucket for each player or team may be placed 15 feet away or closer or farther to alter the degree of difficulty. Upon the first set of players, one from each team, completing their single throws, the next-set of players, one from each team, take turns tossing a ball at the bucket. The routine of players form each team taking turns tossing the ball at their target bucket is repeated until all the players on every team have taken tosses to complete one round of playing. The points scored by each player on the same team is totaled to provide a team score, or in the case of single player teams, player scores are totaled to provide a player score. The team or player with the highest total can be considered the winner or the game can continue with additional rounds.

The preferred method of awarding points for different throw results is to award one point to a player whose tossed ball makes contact with any part of the bucket, award two points to a player whose tossed ball enters the inside of the receptacle of the bucket and comes out of the receptacle, and award three points to a player whose tossed ball enters the receptacle of the bucket and remains inside the receptacle. To equalize the chance of winning by any team, more skilled players can be made to throw at the bucket from a farther distance then the less skilled players.

Obviously, numerous modifications and variations of the present invention are possible in light of the above teachings. For example, players with less skill, such as children, may take two tosses for every single toss taken by a more skilled player, such as an adult. It is therefore understood that within the scope of the appended claims, the invention may be practiced otherwise than as specifically described herein.

What is claimed is:

1. A bucket ball device comprising:

(a) a base having a protruding shaped member extending from a center of said base, said base being nearly flat;

(b) a plurality of dual bucket sections for assembly into a receptacle attachable to said base, said plurality of dual bucket sections being hollow, each dual bucket section being removably attachable to at least one other dual bucket section, said plurality of dual bucket sections including at least one top section and a mounting section, said top section having a receptor end and a mating end being removably attachable to another one of said plurality of dual bucket sections, said receptor end being capable of accepting a thrown ball and of removably attaching to one of said plurality of dual bucket sections, said mounting section having a section end and a mounting end, said section end being removably attachable to one of said plurality of dual bucket sections, said mounting end being removably attachable to said protruding shaped member.

2. The bucket ball device of claim 1 wherein when a last top section is removed, the remaining of said plurality of dual bucket sections form a shorter receptacle having another top section with a narrower receptor end than the receptacle formed with said last top section whereby it takes more skill for causing a thrown ball to enter said narrower receptor end.

3. The bucket ball device of claim 1 wherein said base and said plurality of dual bucket sections are formed from plastic.

4. The bucket ball device of claim 1 wherein said base and said plurality of dual bucket sections are formed from rubber.

5. The bucket ball device of claim 1 wherein said receptor end of said top section has a perimeter on a plane acutely angled from said base when said bucket sections are assembled as said receptacle and removably attached to said base.

6. The bucket ball device of claim 1 wherein said dual bucket sections when assembled as said receptacle have a circular cross section at a right angle to the vertical center line of each of said bucket sections and outwardly sloping inner and outer surface areas.

7. The bucket ball device of claim 1 wherein said protruding shaped member of said base, said bucket section, said mating section and said mounting end are removably attachable by mating male and female threads.

8. The bucket ball device of claim 1 wherein said protruding shaped member of said base, said bucket section, said mating section and said mounting end are removably attachable by a slip joint.

9. The bucket ball device of claim 2 wherein said base and said plurality of dual bucket sections are formed from plastic.

10. The bucket ball device of claim 2 wherein said base and said plurality of dual bucket sections are formed from rubber.

11. The bucket ball device of claim 9 wherein said receptor end of said top section has a perimeter on a plane acutely angled from said base when said bucket sections are assembled as said receptacle and removably attached to said base.

12. The bucket ball device of claim 11 wherein said dual bucket sections when assembled as said receptacle have circular cross section at a right angle to the vertical center line of each of said bucket sections and outwardly sloping inner and outer surface areas.

13. The bucket ball device of claim 12 wherein said protruding shaped member of said base, said bucket section, said mating section and said mounting end are removably attachable by mating male and female threads.

14. The bucket ball device of claim 12 wherein said protruding shaped member of said base, said bucket section, said mating section and said mounting end are removably attachable by a slip joint.

* * * * *